US011022303B2

(12) United States Patent
Huang et al.

(10) Patent No.: US 11,022,303 B2
(45) Date of Patent: Jun. 1, 2021

(54) COMBUSTION DEVICE

(71) Applicant: Grand Mate Co., Ltd., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Yen-Jen Yeh, Taichung (TW); Kuan-Chou Lin, Taichung (TW)

(73) Assignee: Grand Mate Co., Ltd., Taichung (TW)

( * ) Notice: Subject to any disclaimer, the term of this patent is extended or adjusted under 35 U.S.C. 154(b) by 334 days.

(21) Appl. No.: 16/164,097

(22) Filed: Oct. 18, 2018

(65) Prior Publication Data

US 2020/0124277 A1 Apr. 23, 2020

(51) Int. Cl.
*F23D 14/14* (2006.01)

(52) U.S. Cl.
CPC ..... *F23D 14/145* (2013.01)

(58) Field of Classification Search
CPC ... F23D 14/12; F23D 14/145; F23D 2203/005
USPC ..... 431/347, 326–329; 126/92, 92 B
See application file for complete search history.

(56) References Cited

U.S. PATENT DOCUMENTS 1,929,088 A * 10/1933 Wood ..... A01K 31/19 119/304
2,310,116 A * 2/1943 Ratcliff ..... F23D 91/02 431/347
6,149,424 A * 11/2000 Marrecau ..... F23D 14/16 126/92 AC
7,611,351 B2 * 11/2009 Krauklis ..... F23D 14/66 431/328
2005/0172915 A1 8/2005 O'Donnell et al.

FOREIGN PATENT DOCUMENTS

| | | | |
|---|---|---|---|
| CN | 2412345 | Y | 12/2000 |
| CN | 2753447 | Y | 1/2006 |
| CN | 201551189 | U | 8/2010 |
| CN | 202350043 | U | 7/2012 |
| CN | 203963934 | U | 11/2014 |
| CN | 204380436 | U | 6/2015 |
| EP | 2876369 | A1 | 5/2015 |
| EP | 3505824 | A2 | 7/2019 |
| JP | H02154623 | A | 6/1990 |

(Continued)

OTHER PUBLICATIONS

English Abstract for TWM563762, Total of 1 page.

(Continued)

*Primary Examiner* — Vivek K Shirsat
(74) *Attorney, Agent, or Firm* — Tracy M Helms; Apex Juris, pllc

(57) ABSTRACT

A combustion device includes at least one burner, a supporting assembly, and an infrared ray generation mesh wherein, the at least one burner includes a flame outlet, and the infrared ray generation mesh which is corresponding to the flame outlet is disposed on a rear cover of the supporting assembly. An outer surface of the infrared ray generation mesh is exposed outside. The infrared ray generation mesh is heated by flames out of the flame outlet. Whereby, open fire and thermal energy of the infrared ray can be generated so as to effectively increase heating intensity and realize uniformly heating as well.

21 Claims, 20 Drawing Sheets

(56) References Cited

FOREIGN PATENT DOCUMENTS

| | | |
|---|---|---|
| TW | 89876 | 8/1987 |
| TW | M258256 U | 3/2005 |
| TW | M543657 U | 6/2017 |
| TW | M563762 U | 7/2018 |

OTHER PUBLICATIONS

Examination Report for TW107130603, dated Apr. 30, 2019, Total of 6 pages.
Search Report for TW107130603, dated Apr. 30, 2019, Total of 1 page.
English Abstract for TWM258256, Total of 1 page.
Extended European search for EP19193550.1, dated Dec. 12, 2019, Total of 7 pages.
English abstract for TWM543657, Total of 1 page.
English abstract for CN2412345, Total of 1 page.
English abstract for CN2753447, Total of 1 page.
English abstract for CN201551189, Total of 1 page.
English abstract for CN202350043, Total of 1 page.
English abstract for CN203963934, Total of 1 page.
English abstract for CN204380436, Total of 1 page.
English abstract for JPH02154623, Total of 1 page.
Chinese search report for CN201811015296.9, dated Dec. 3, 2020, Total of 3 pages.

* cited by examiner

COMBUSTION DEVICE

BACKGROUND OF THE INVENTION

1. Technical Field

The present invention is related to a heating device, and more particularly to a combustion device which uses infrared rays and open fire to heat.

2. Description of Related Art

Generally, gas combustion devices burn gas to generate flame for heating an object. When using gas combustion devices to heat an object, heat is conducted from the surface of the object to the inside of the object such that the surface is heated greater while the interior gets less heat, resulting in the object not being heated uniformly.

To resolve the above problem, there is a known infrared ray heating source device, as the combustion device shown in Taiwan Utility Model M563762, which is characterized by penetrating objects with infrared rays and heating the surface as well as the interior simultaneously. The a latter patent includes a burner 42 generating a flame for heating the infrared ray generation mesh 542 and the cover plate 84 to generate infrared rays whereby, the curved cover plate 84 scatters infrared rays such that the infrared rays generated by the mesh passes through the holes 484 of the cover plate 84 and scatters outwardly. However, the infrared rays generated by the mesh is partly blocked by the cover plate. Thus, when the infrared rays scattered by the infrared heating source applies to an object, the limited infrared per unit area reaching the objected is consequently limited.

Hence, there remains a persisting need to improve the design of such conventional infrared heating source devices so as to address the aforementioned drawbacks.

BRIEF SUMMARY OF THE INVENTION

In view of the above drawbacks of the prior art, a purpose of the present invention is to provide a combustion device enhancing the amount of infrared rays reaching an object.

The present invention provides a combustion device including at least one burner, an infrared ray generation mesh and an infrared reflective plate. Wherein, the at least one burner has a flame outlet and is for burning gas to generate flame through the flame outlet; the infrared ray generation mesh is corresponding to the flame outlet and has a first surface and a second surface positioned back-to-back, wherein the first surface is exposed outside; the infrared ray generation mesh is flame heated by the at least one burner to generate infrared rays; the infrared reflective plate is disposed on outside the second surface of the infrared ray generation mesh, and the infrared reflective plate has a reflective surface facing the second surface.

The advantage of the present invention is to expose the infrared ray generation mesh outside directly so as to keep infrared intensity which an object receives per unit area unrestricted to the cover plate when the infrared rays scattered by the combustion device applies to the object.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

The following illustrative embodiments and drawings are provided to illustrate the disclosure of the present invention, these and other advantages and effects can be clearly understood by persons skilled in the art after reading the disclosure of this specification.

Figure 1:
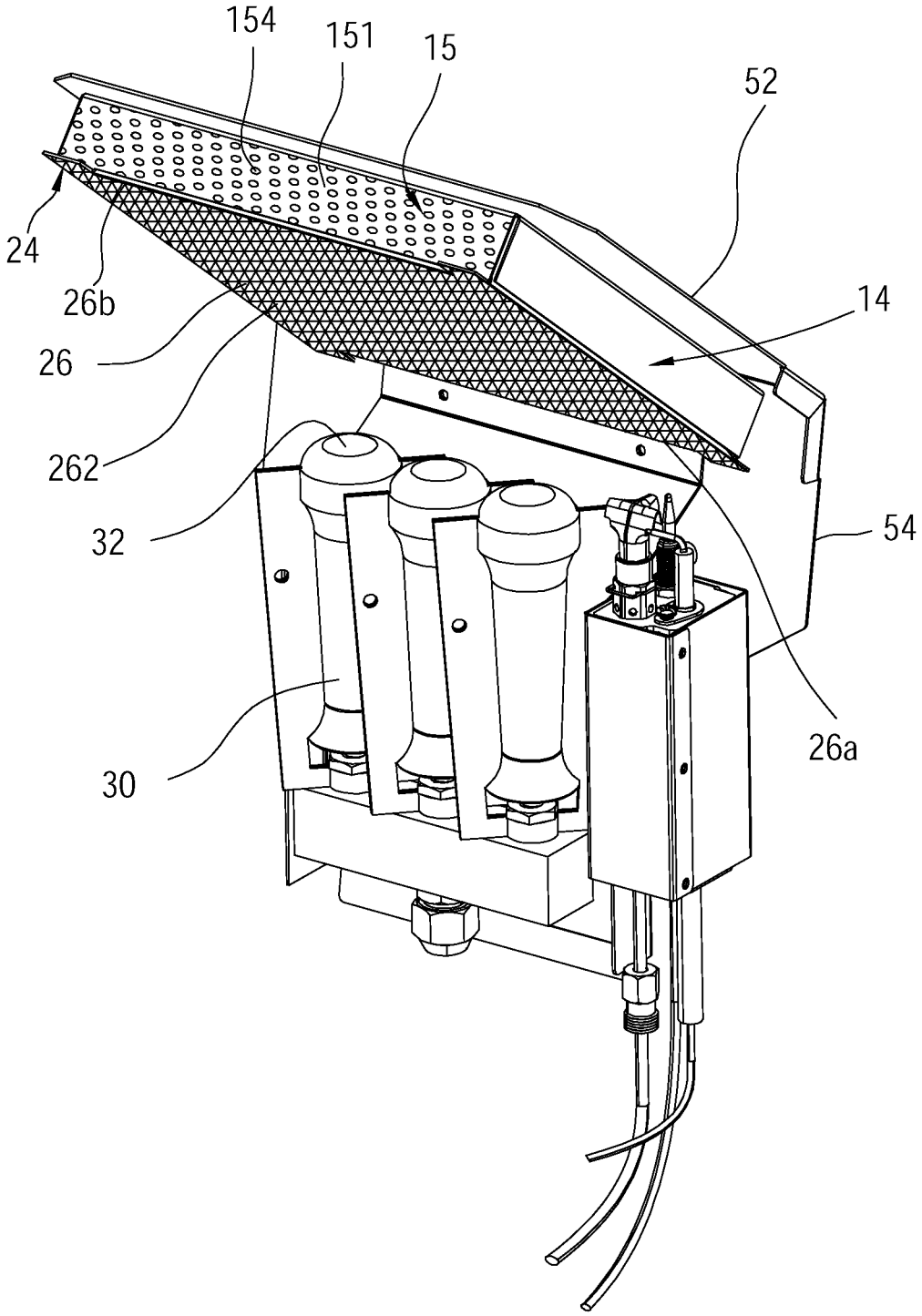
FIG. 1 is a perspective view of a combustion device of a first embodiment according to the present invention.
Figure 2:
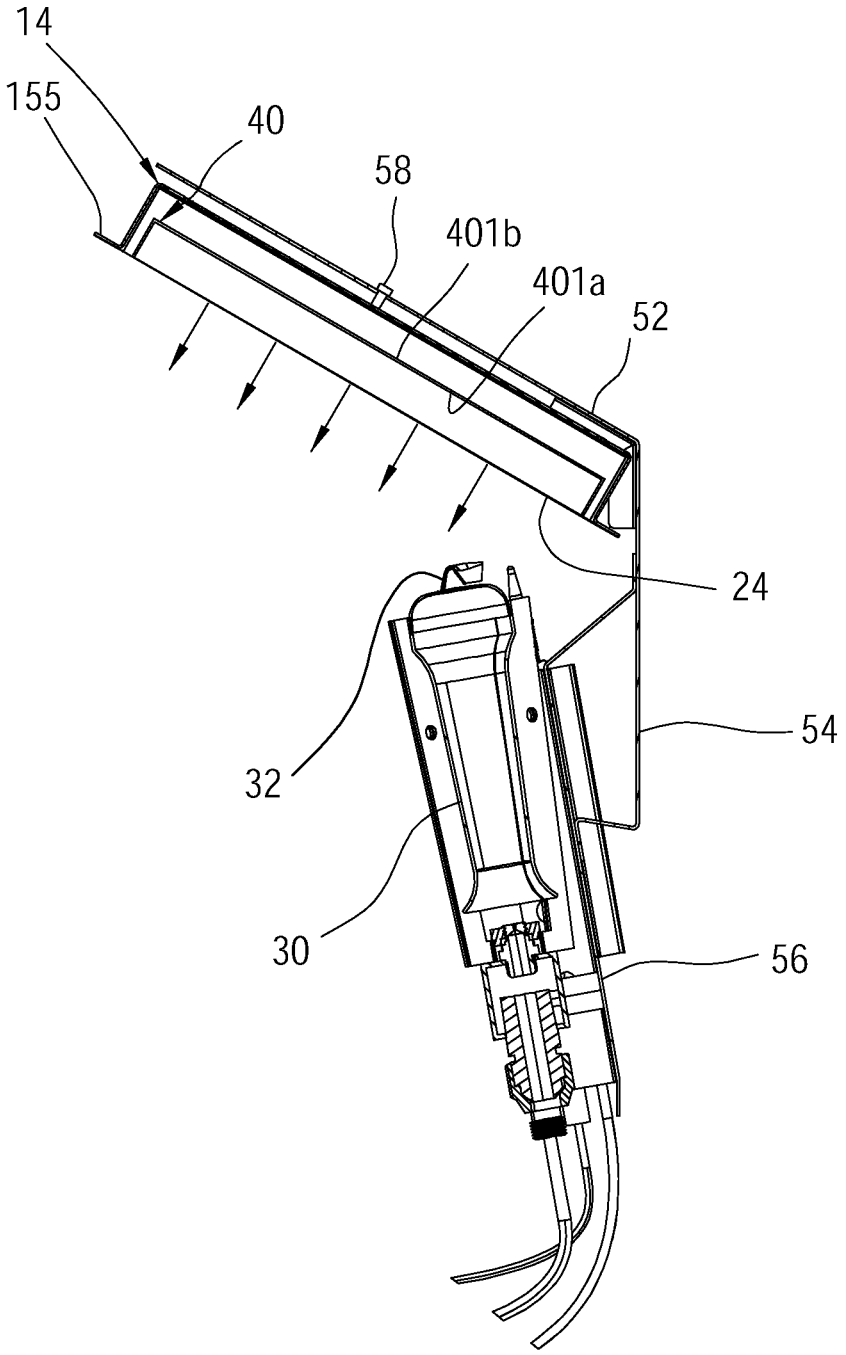
FIG. 2 is a cross-sectional view of the combustion device of the first embodiment.
Figure 3:
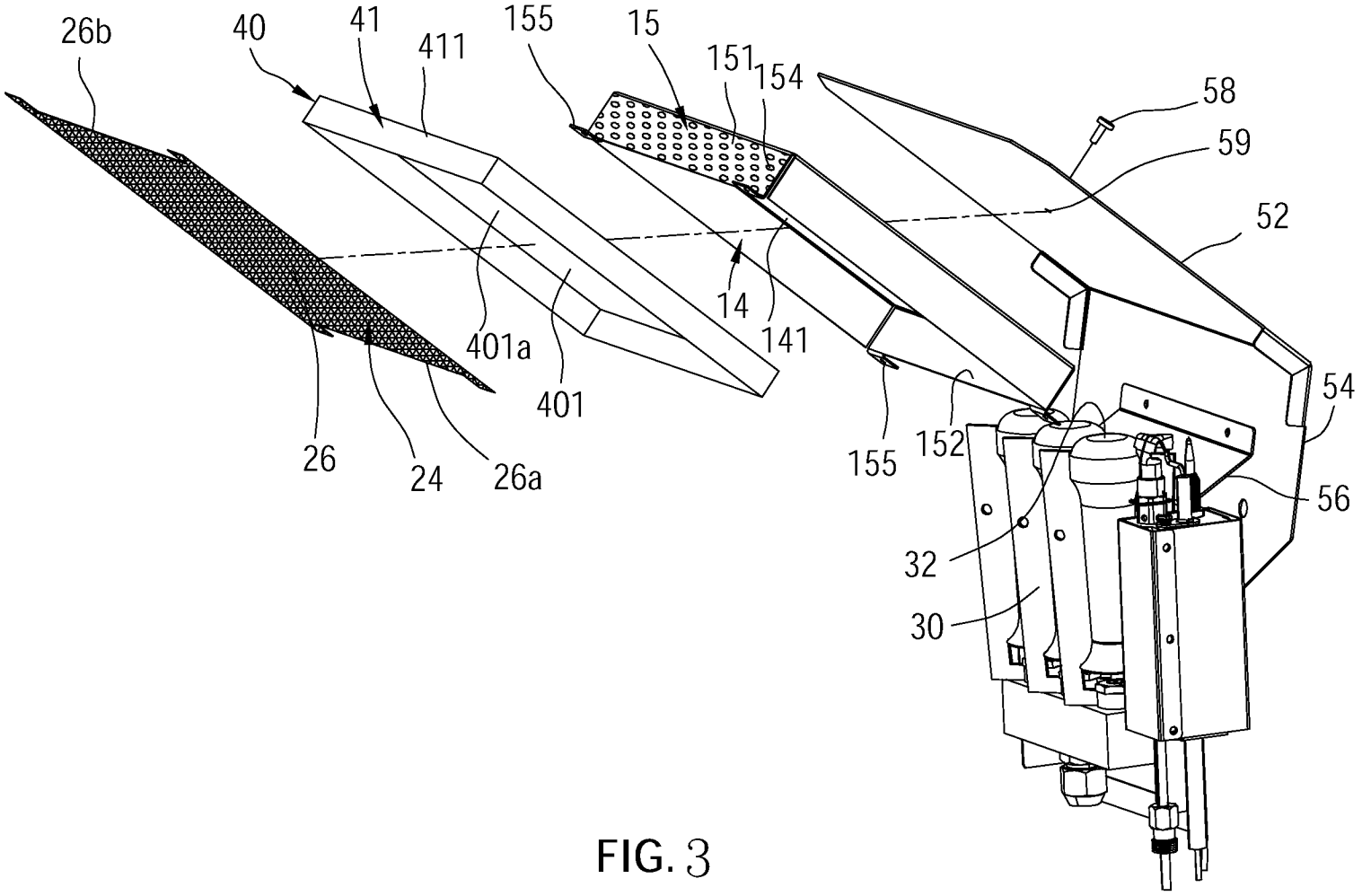
FIG. 3 is an exploded view of the combustion device of the first embodiment.

As illustrated in FIG. 1 to FIG. 3, a combustion device of the first embodiment according to the present invention includes a supporting assembly 10, an infrared ray generation mesh 24, an infrared reflective plate 40 and at least one burner 30.

As illustrated in FIG. 3, the supporting assembly 10 includes a metallic rear cover 14 which is tilted and has a flat rectangular rear plate 141. The rear cover 14 includes a surrounding wall 15 connected to a peripheral edge of the rear plate 14. The surrounding wall 15 comprises an upper side wall 151 and a lower side wall 152, wherein the upper side wall 151 is connected to a top edge of the rear plate 141 and has a plurality of holes 154 passing between an interior surface and an exterior surface of upper side wall 151. The surrounding wall 15 of the rear cover 14 extends outwards to form a plurality of extension parts 155 wherein the extension parts 155 are located respectively on the upper side wall 151 and the lower side wall 152.

As illustrated in FIG. 3, the infrared ray generation mesh 24 is metallic material and, in the current embodiment, is iron-chromium-aluminum alloy. The infrared ray generation mesh 24 includes a flat rectangular mesh body 26 which has a first surface 262 and a second surface 264 positioned back-to-back and a peripheral edge as well, wherein the first surface 262 is not shielded but exposed outside directly, the peripheral edge of mesh body 26 has four sides and two of opposite ones form a first part 26*a* and a second part 26*b*. In practice, the peripheral edge of the mesh body 26 can be circular and be divided into two halves by a diameter thereof, wherein the first part 26*a* and the second part 26*b* are located respectively on the two halves. In addition, the infrared ray generation mesh 24 is joined to the extension parts 155 by bolt-nut combining or welding to fix the infrared ray generation mesh 26 to the rear cover 14.

Furthermore, the mesh body 26 of the infrared ray generation mesh 24 has a cover rate ranging from 43% to 64% per unit area. In the current embodiment, each wire diameter of the mesh body 26 is 0.2 mm and the mesh body 26 has 1600 mesh pores (40×40=1600) per square inch. It is able to be deduced that each opening area of the mesh pores per square inch is 302.76 $mm^2$ with the formula of $(25.4-(40\times 0.2))^2=302.76$. Meanwhile, the mesh body 26 has a cover rate of 53.07% per unit area with the formula of $(25.4^2-302.76)/(25.4^2)\times 100\%=53.07\%$. Thus, more preferably, the cover rate per unit area of mesh body 26 is about 53% to 54%.

As illustrated in FIG. 1, the at least one burner 30 has a flame outlet 32 near the first part 26*a* of the infrared ray generation mesh 24, and the first surface 262 corresponds to the flame outlet 32. The at least one burner 30 is for burning gas to generate flame through the flame outlet 32, whereby the flame applies to the infrared ray generation mesh 24 and flows along from the first part 26*a* toward the second part 26*b*. In the current embodiment, the at least one burner 30 includes a plurality of burners 30, each flame outlet 32 of which generates flame and heats the infrared ray generation mesh 24. In practice, it works as long as the flame is applied to the infrared ray generation mesh 24, that is, it is feasible as long as the flame outlets 32 of the burners 30 are disposed near the infrared ray generation mesh 24.

As illustrated in FIG. 2, the infrared reflective plate 40 is disposed between the rear cover 14 of the supporting assembly 10 and the infrared ray generation mesh 24. The infrared reflective plate 40 which is tilted includes a flat rectangular main board 401 (as shown in FIG. 3) corresponding to the infrared ray generation mesh 24*d*, and the infrared reflective plate 40 further comprises a surrounding wall 41 connected to a peripheral edge of the main board 401. The surrounding wall 41 of the infrared reflective plate 40 has an upper side wall 411 connected to a top edge of the main board 401, wherein a height of the surrounding wall 41 of the infrared reflective plate 40 is lower than that of the surrounding wall 15 of the rear cover 14. The infrared reflective plate 40 includes a reflective surface 401*a* and an exterior surface 401*b* positioned back-to-back, wherein the reflective surface 401*a* facing the second surface 264 of the infrared ray generation mesh 24 reflects back infrared rays generated by the infrared ray generation mesh 24, such that the reflected infrared rays apply to the infrared ray generation mesh 24 and emit outwardly. The infrared reflective plate 40 is metallic, such as stainless steel.

In the current embodiment, the combustion device further comprises a bracket 50. As illustrated in FIG. 3, the bracket 50 includes an upper supporting plate 52, a middle supporting plate 54, a lower supporting plate 56 and an engaged member 58. The bracket 50 is for fixing the rear cover 14 and the burners 30 so as to be at the relative position. The middle supporting plate 54 is connected between the upper supporting plate 52 and the lower supporting plate 56. A fixed hole 59 is near the center of the upper supporting plate 52, wherein the engaged member 58 penetrates the fixed hole 59 of the upper supporting plate 52 to fix the rear cover 14 to the upper supporting plate 52, while the burners 30 are fixed to the lower supporting plate 56 by another engaged member (not shown).

As illustrated in FIG. 2, when flames generated by the flame outlets from the burners 30 heats the infrared ray generation mesh 24, the infrared ray generation mesh 24 is heated by open fire to generate infrared rays. Part of the infrared rays are emitted outwardly from the first surface 262, while another part of the infrared rays are emitted from the second surface 264 toward the reflective surface 401*a* of the infrared reflective plate 40. The reflective surface 401*a* reflects the another part of the infrared rays toward the infrared ray generation mesh 24 so as to accumulate more thermal energy generated by the infrared rays on the infrared ray generation mesh 24, increase heating the infrared ray generation mesh 24, and rise in temperature to generate more infrared rays. The infrared rays would be emitted outwardly from the infrared ray generation mesh 24 again to reinforce the infrared intensity applied to an object by the combustion device.

Figure 4:
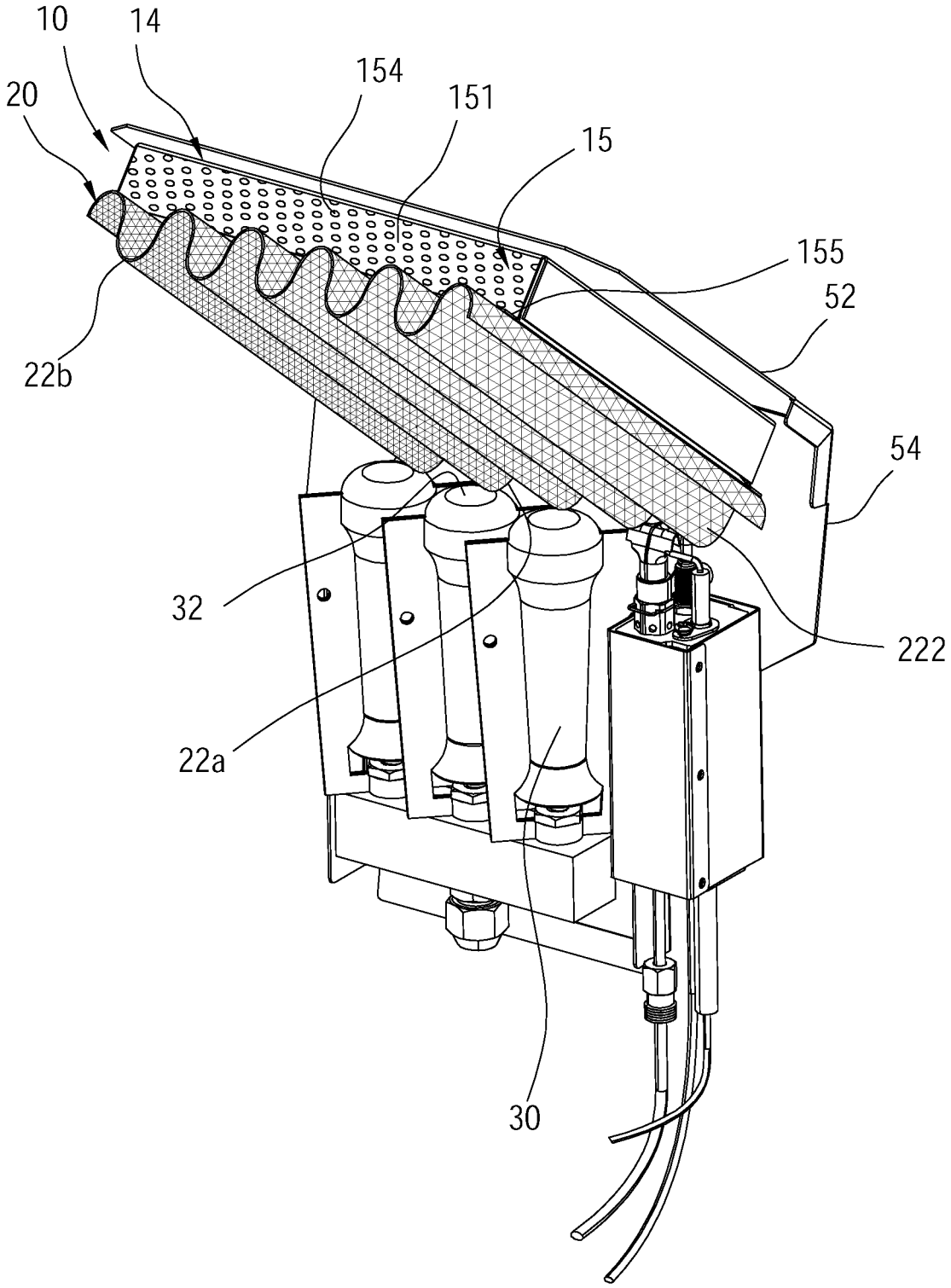
FIG. 4 is a perspective view of a combustion device of a second embodiment.
Figure 5:
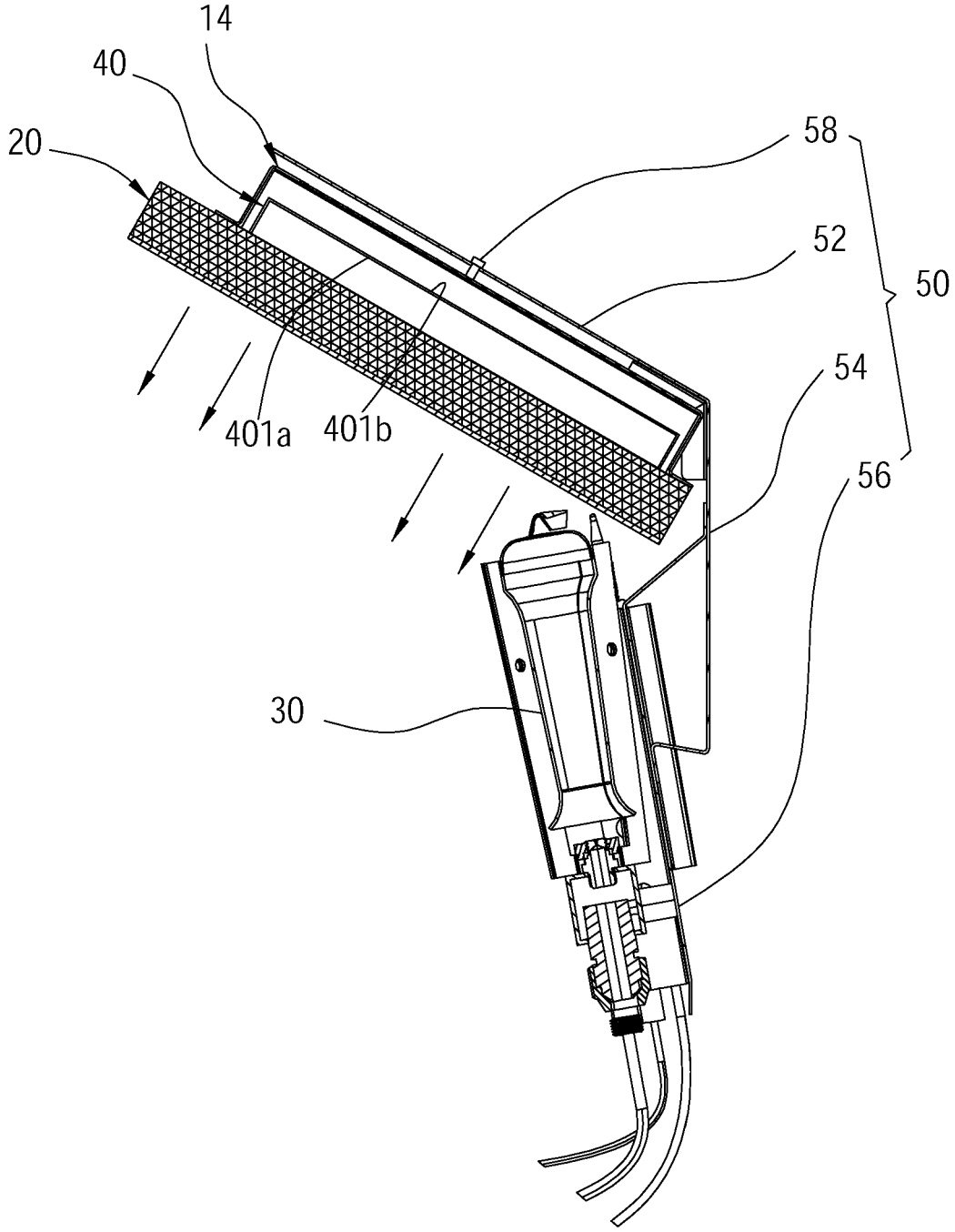
FIG. 5 is a cross-sectional view of the combustion device of the second embodiment.
Figure 6:
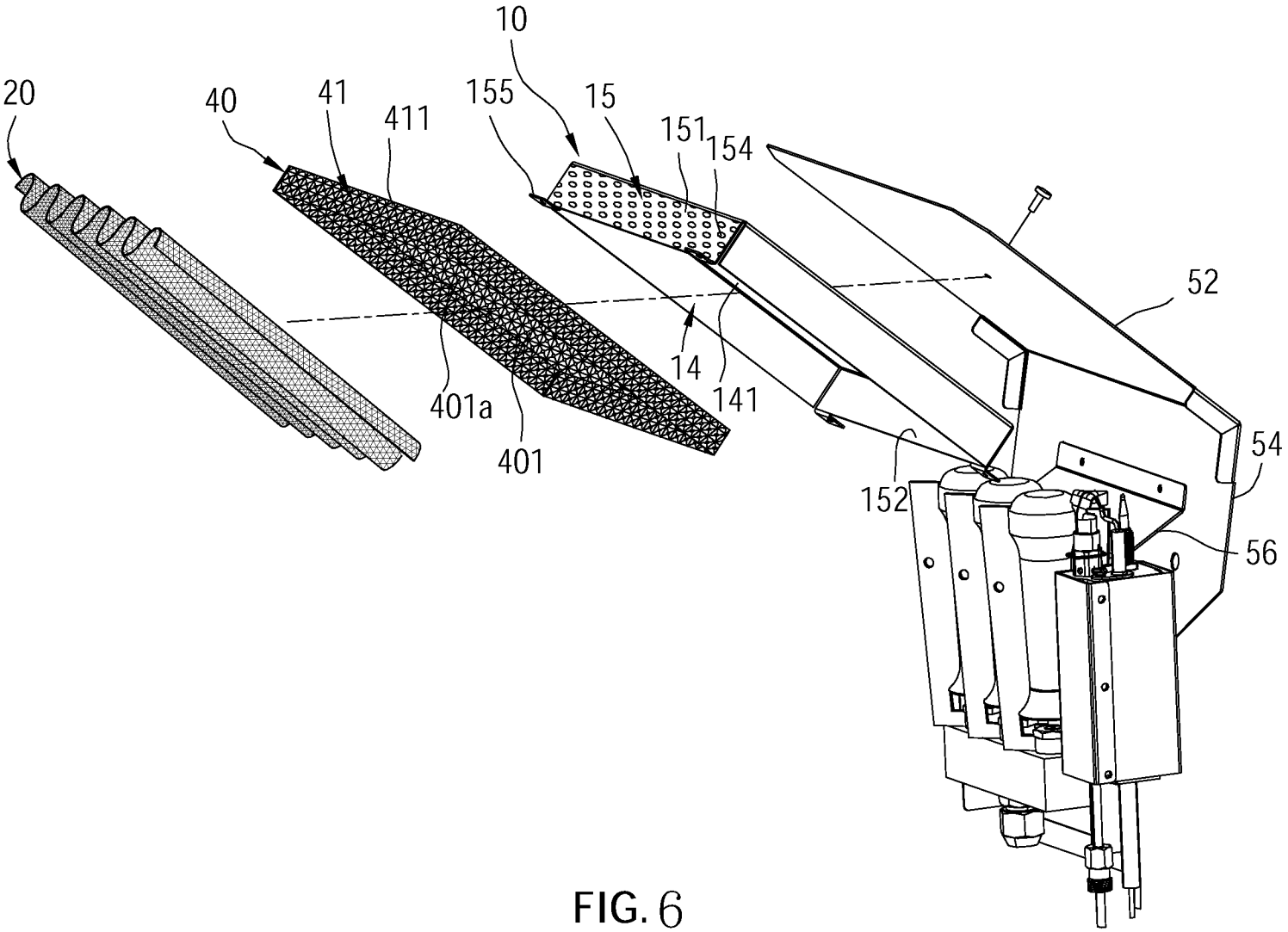
FIG. 6 is an exploded view of the combustion device of the second embodiment.
Figure 7:
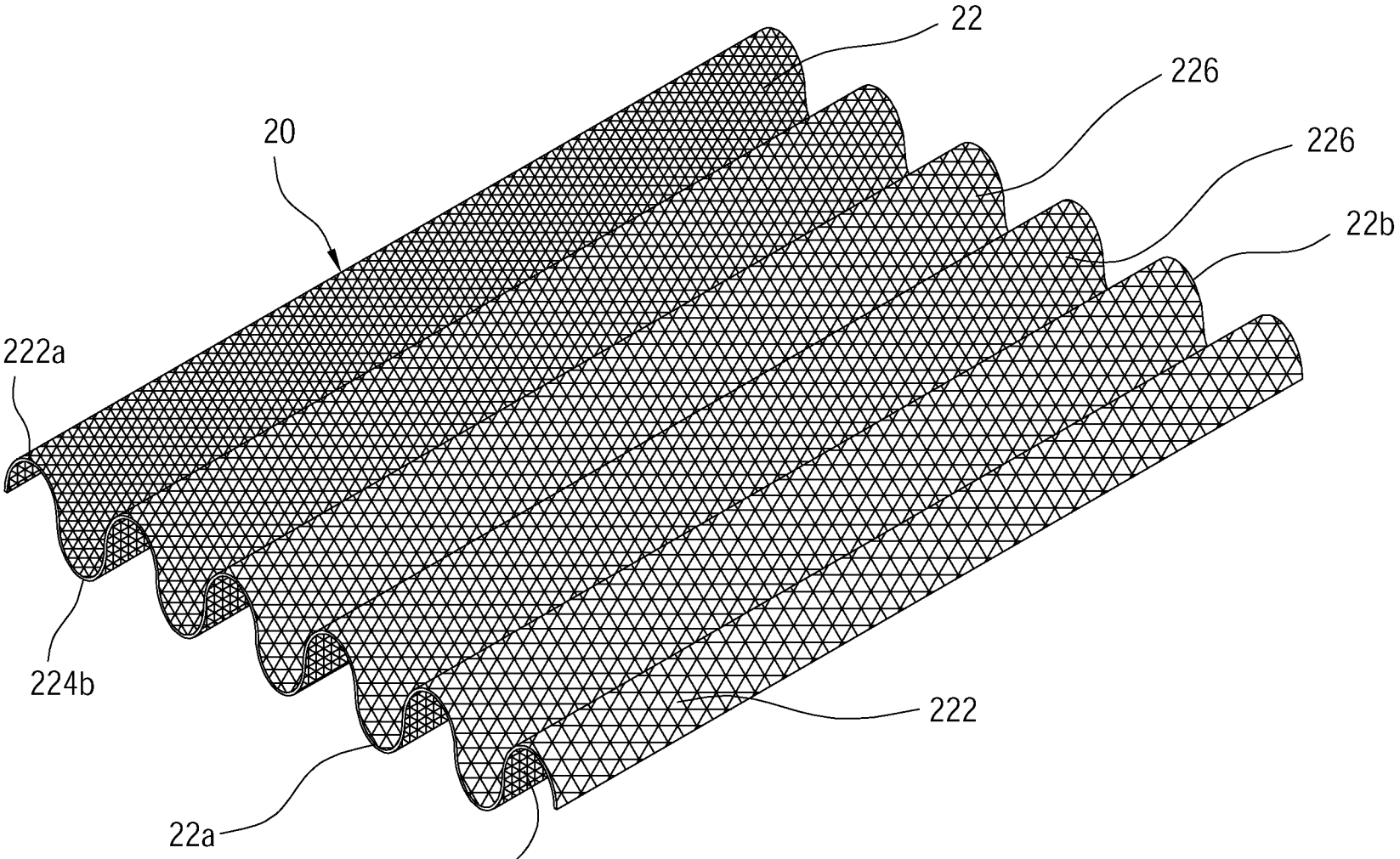
FIG. 7 is a perspective view of an infrared ray generation mesh of the second embodiment.
Figure 8:
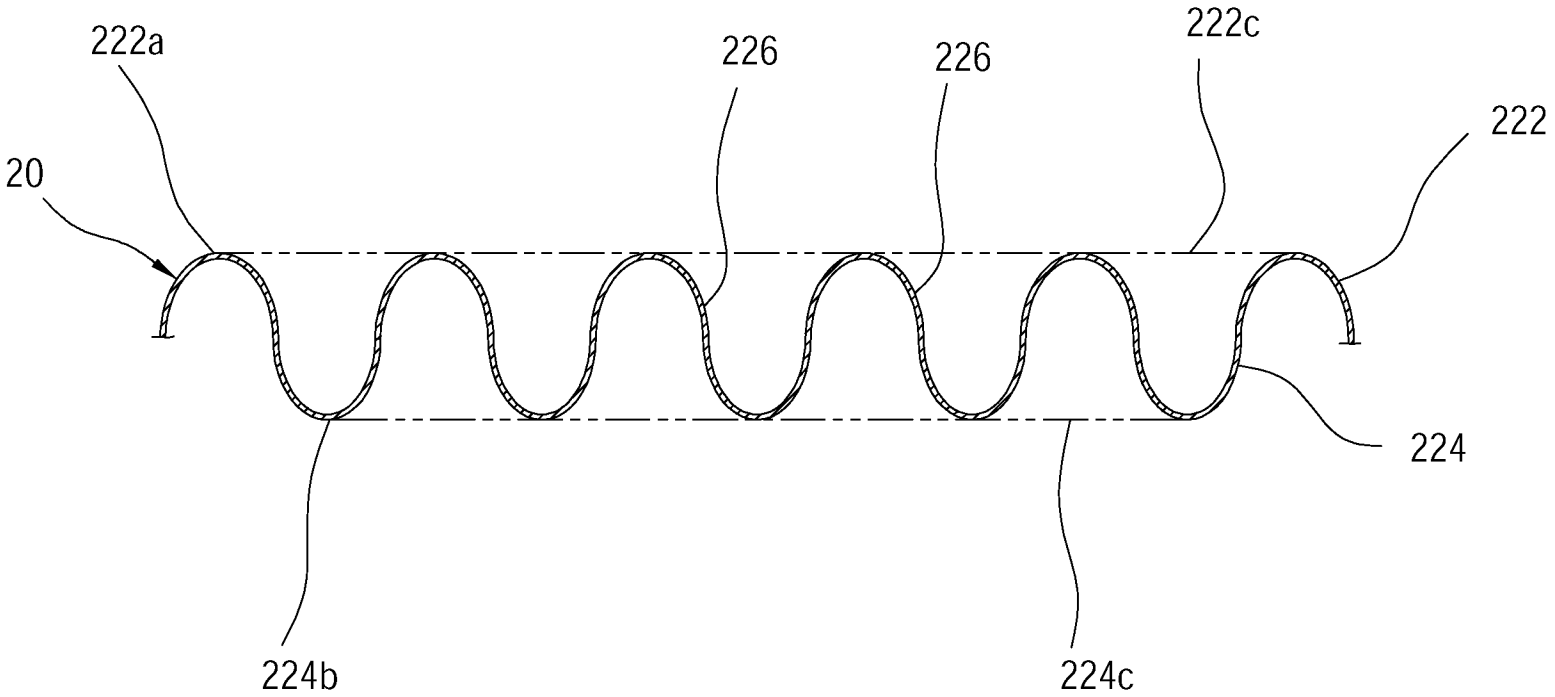
FIG. 8 is a cross-sectional view of the infrared ray generation mesh of the second embodiment.

As illustrated in FIGS. 4, 5 and 6, a combustion device of the second embodiment according to the present invention includes a structure which is similar to that of the first embodiment. The combustion device of the current embodiment is different from that of the first embodiment in that the mesh body of the infrared ray generation mesh 20 of the second embodiment is bent or folded integrally to form a plurality of corrugations 226 which extend parallel from the first part 22*a* to the second part 22*b*. As shown in FIG. 8, a cross section of the corrugations 226 is waved. Wherein, the corrugations 226 have a plurality of first crests 222*a* on the first surface 222 and the first crests 222*a* are located on a defined first reference surface 222*c*; the corrugations 226 have a plurality of second crests 224*b* on the second surface 224 and the second crests 224*b* are located on a defined second reference surface 224*c*. In the second embodiment, the first reference surface 222*c* and the second reference surface 224*c* are both flat; in other words, the first crests 222*a* are on the same plane and the second crests 224*b* are on another same plane, but it is not limited thereto. The first crests 222*a* need not be on the same plane and the second crests 224*b* need not be on another same plane either.

In addition, since the infrared ray generation mesh 20 is waved, the corrugations 226 extending from the first part 22*a* to the second part 22*b* help to guide the flame generated by the flame outlet 32 to flow more smoothly along the corrugations 226 from first part 22*a* toward the second part 22*b* such that the infrared ray generation mesh 20 is heated by the flame more uniformly and the infrared intensity emitted by the combustion device increases. In this way, it is able to enlarge the heating area applied by the infrared rays which are emitted by the combustion device and increase the infrared intensity per unit area. Thus, to adopt the combustion device with a corrugated infrared ray generation mesh 20 not only helps resolve the restriction of heating range but further improves the infrared intensity generated by the combustion device to achieve better fire control.

Figure 9:
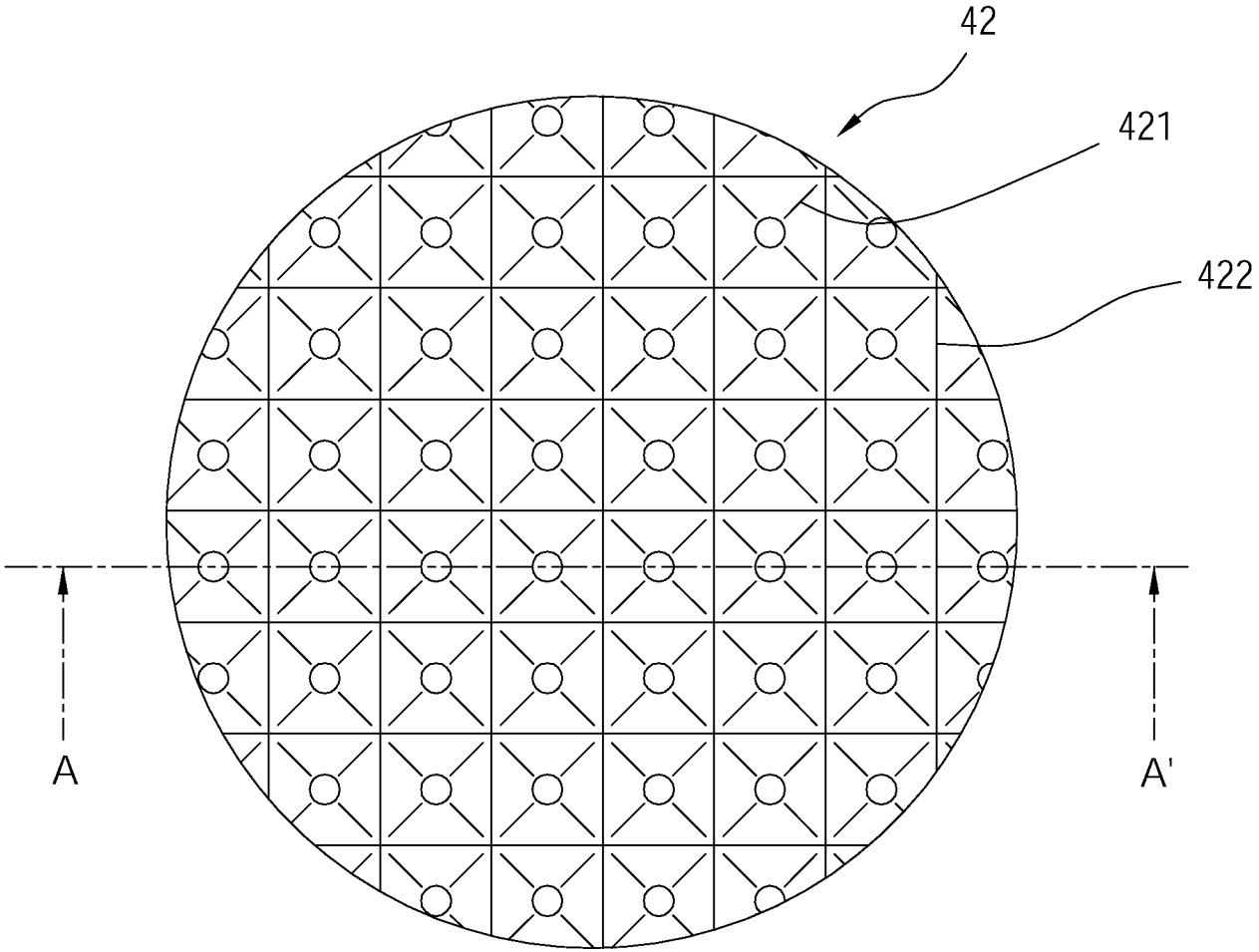
FIG. 9 is a top view showing a matrix arrangement of a reflective structure of an infrared reflective plate of the second embodiment.
Figure 10:
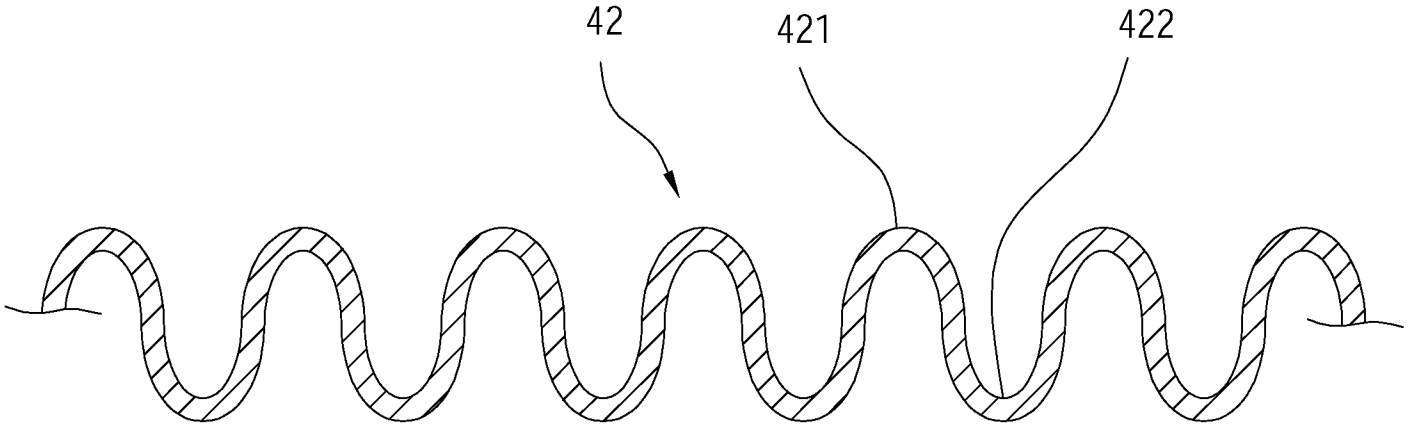
FIG. 10 is a cross-sectional view of FIG. 9 along lines A-A'.
Figure 11:
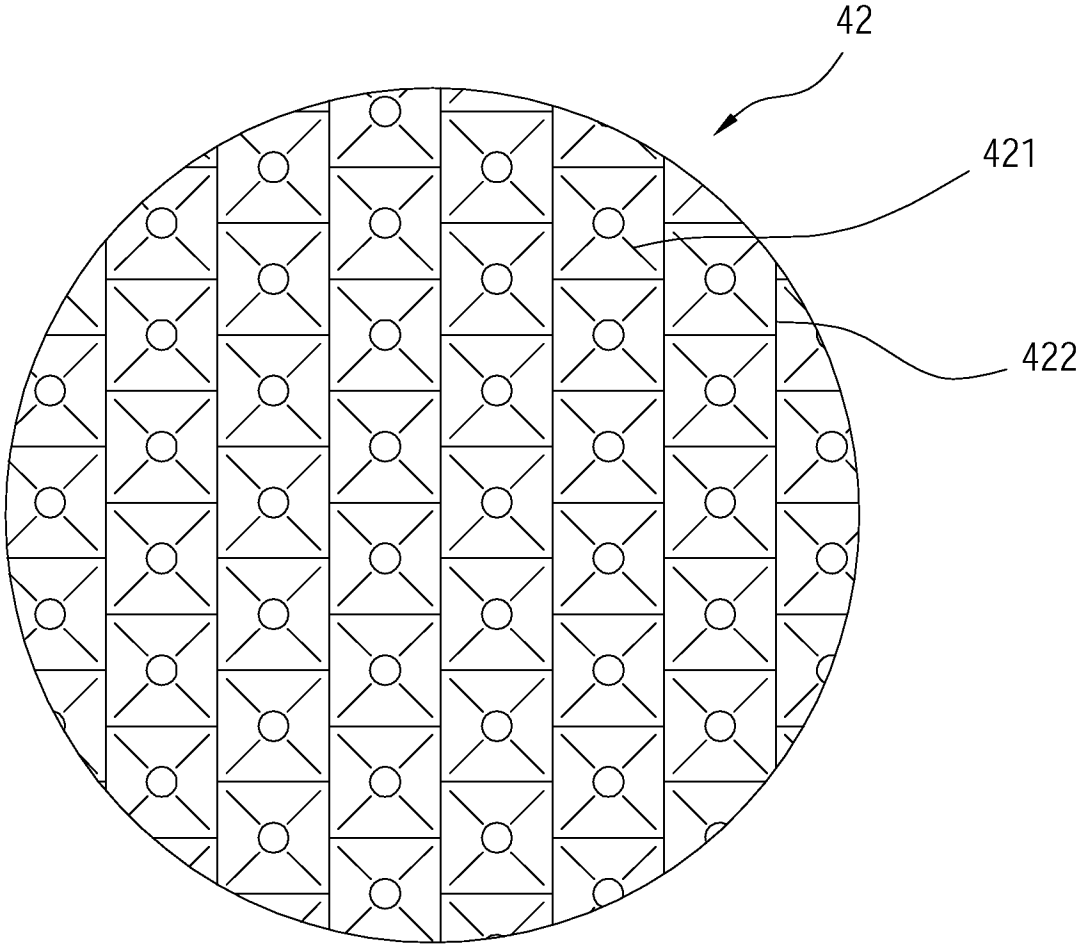
FIG. 11 is a top view showing a staggered arrangement of the reflective structure of the infrared reflective plate of the second embodiment.

Incidentally, in the current embodiment, the reflective surface 401*a* of the infrared reflective plate 40 includes a reflective structure 42 which comprises a plurality of convex parts 421 and a plurality of embossings 422, each of the embossings located between two adjacent convex parts. The convex parts 421 and the embossings 422 are roll-embossed out of a metallic plate, and then the metallic plate with the reflective structure 42 is folded to form the shape of the main board 401 and the surrounding wall 41 such that the infrared reflective plate 40 is full of the reflective structure 42. In the current embodiment, the convex parts 421 are conical and form a matrix arrangement (as shown in FIGS. 9 and 10) or a staggered arrangement (as shown in FIG. 11). Wherein, the reflective structure 42 is for reflecting incident infrared rays of the reflective surface 401*a* to scatter the incident infrared rays of the reflective surface 401*a* back on the infrared ray generation mesh 20 again. The infrared ray generation mesh 20 receives the reflected infrared rays, resulting in the infrared ray generation mesh 20 rising in temperature and accumulating more thermal energy for increasing efficiency of generating infrared rays out of the infrared ray generation mesh 20.

Figure 12:
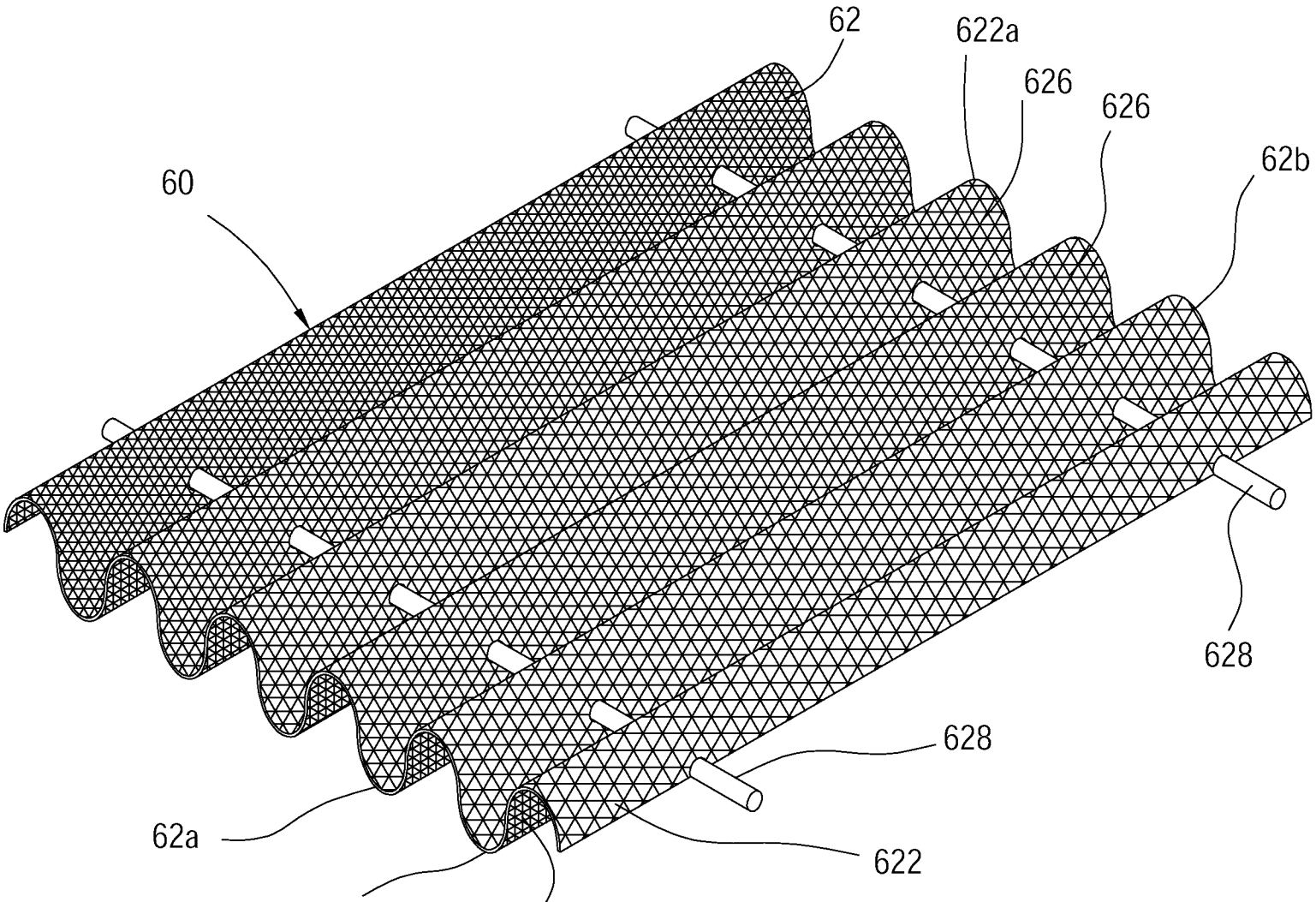
FIG. 12 is a perspective view of an infrared ray generation mesh of a third embodiment.

As illustrated in FIG. 12, an infrared ray generation mesh 60 of the third embodiment according to the present invention includes a structure which is similar to that of the second embodiment. The infrared ray generation mesh 60 of the current embodiment is different from that of the second embodiment in that the mesh body 62 is penetrated by at least one fixation bar 628. In the current embodiment, the at least one fixation bar 628 includes a plurality of fixation bars 628. The fixation bars 628 are joined to the infrared ray generation mesh 60 by penetrating the first surface 622 and the second surface 624, each of the fixation bars being located between the first crests 622*a* and the second crests 624*b* of the corrugations 626. Additionally, the fixation bars 628 need not penetrate the first surface 622 and the second surface 624, but are joined directly to the infrared ray generation mesh 60 by welding to the first crests 622*a* on the first reference surface or the second crests 624*b* on the second reference surface. Whereby, the mesh body 62 is fixed by the at least one fixation bar 628 to prevent deformation of the infrared ray generation mesh 60.

Figure 13:
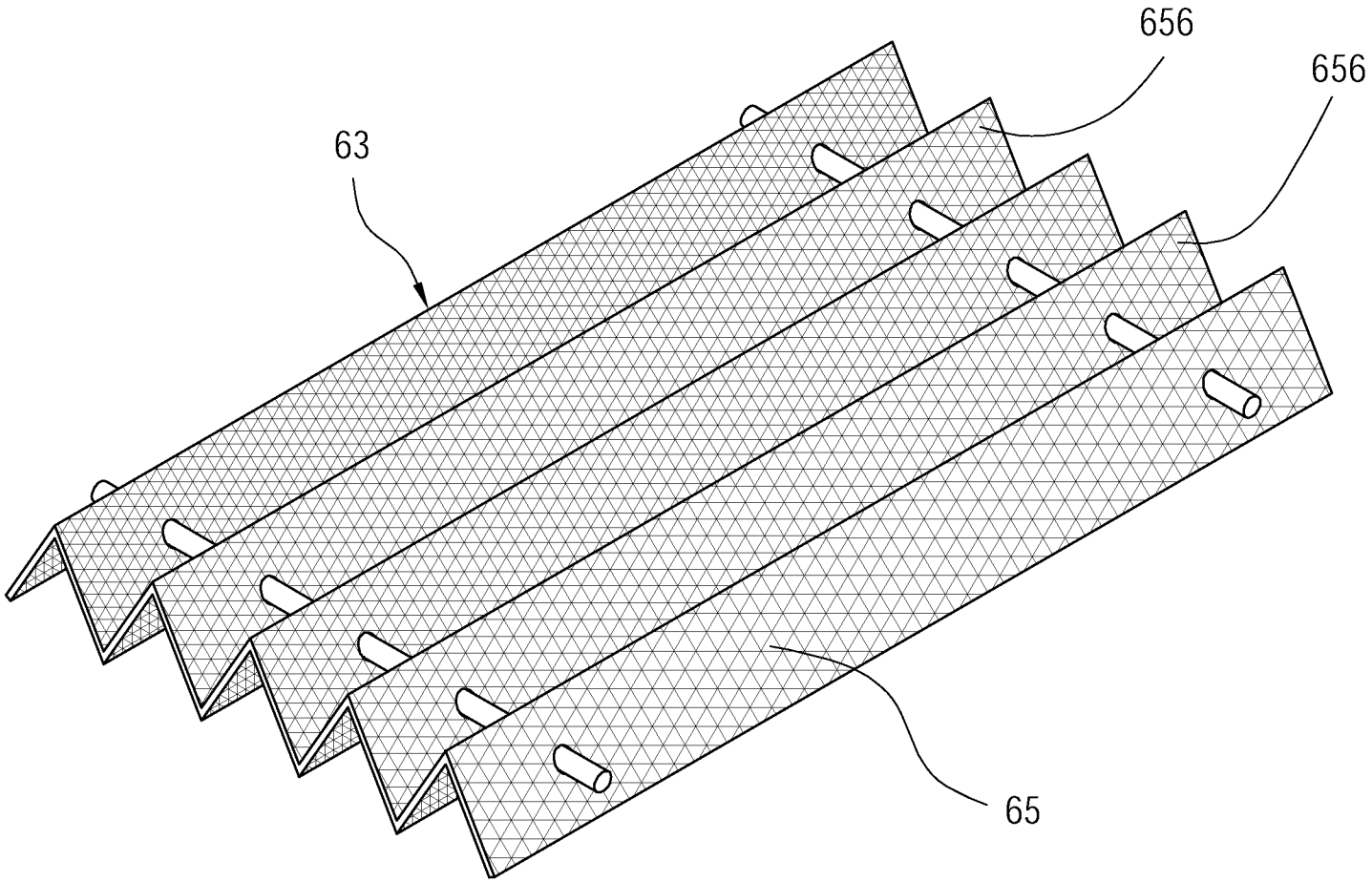
FIG. 13 is a perspective view of an infrared ray generation mesh of a fourth embodiment.

As illustrated in FIG. 13, an infrared ray generation mesh 63 of the fourth embodiment according to the present invention includes a structure which is similar to that of the second embodiment. The infrared ray generation mesh 63 of the current embodiment is different from that of the second embodiment in that a cross section of the corrugations 656 of the infrared ray generation mesh 63 is serrated.

Figure 14:
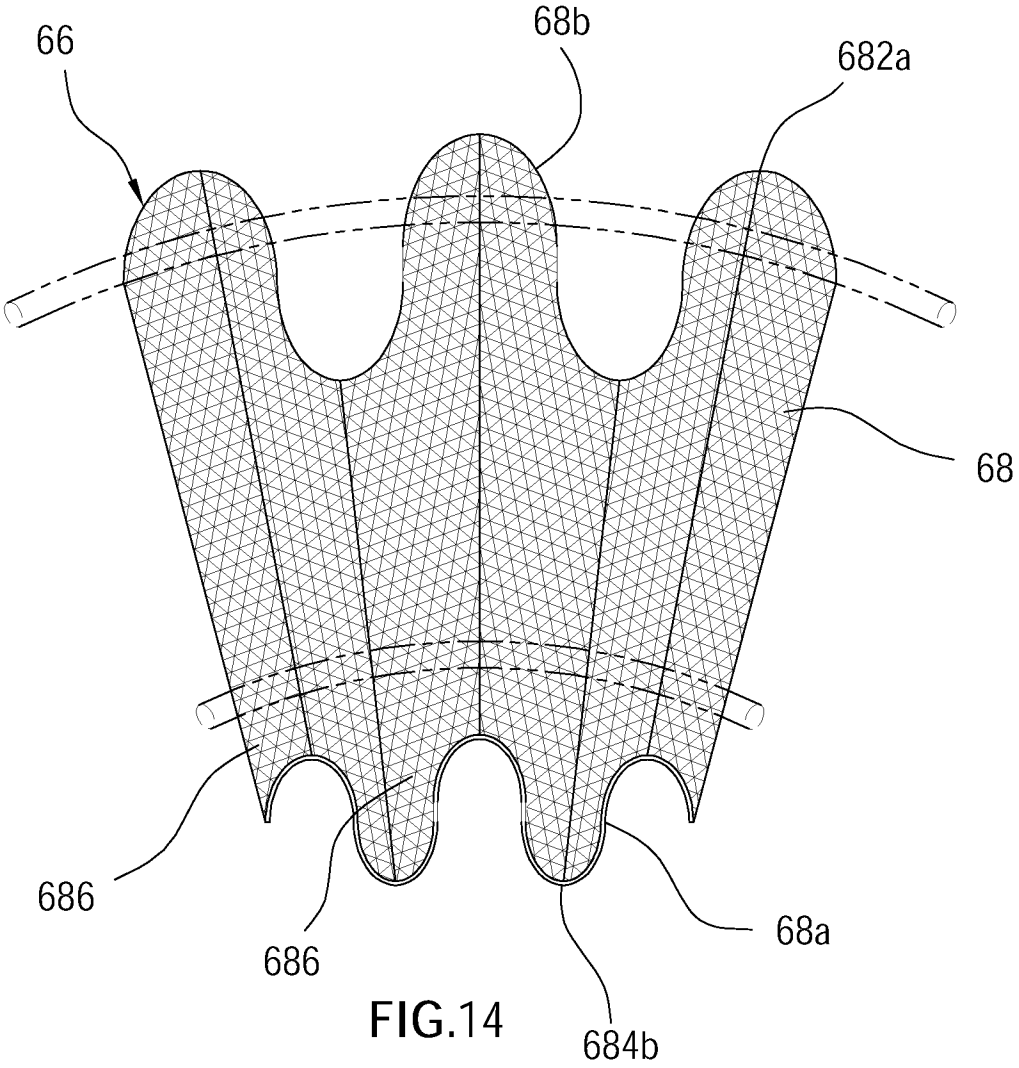
FIG. 14 is a schematic view of an infrared ray generation mesh of a fifth embodiment.

As illustrated in FIG. 14, an infrared ray generation mesh 66 of the fifth embodiment according to the present invention includes a structure which is similar to that of the second embodiment. The infrared ray generation mesh 66 of the current embodiment is different from that of the second embodiment in that a spacing between two adjacent first crests 682*a* and a spacing between two second crests 684*b* of the mesh body 68 are getting larger from the first part 68*a* toward the second part 68*b*, resulting in the fan-shaped mesh body 68 that helps the flame generated by the flame outlets 32 flow along the corrugations 686 from first part 68*a* to the second part 68*b* and expands the flame range so as to enlarge the infrared rays scattering range of the combustion device. In the current embodiment, the first crests 682*a* are located on a first reference surface and the second crests 684*b* are on a second reference surface. The first reference surface and the second reference surface can be a flat or curved surface. In practice, the first crests 682*a* need not on the same reference surface, and the second crests 684*b* need not on another same reference surface. In practice, the second part 68*b* can be located near the flame outlets 32 such that the flame generated by the flame outlets 32 flows along the corrugations 686 from the second part 68*b* to the first part 68*a*.

Figure 15:
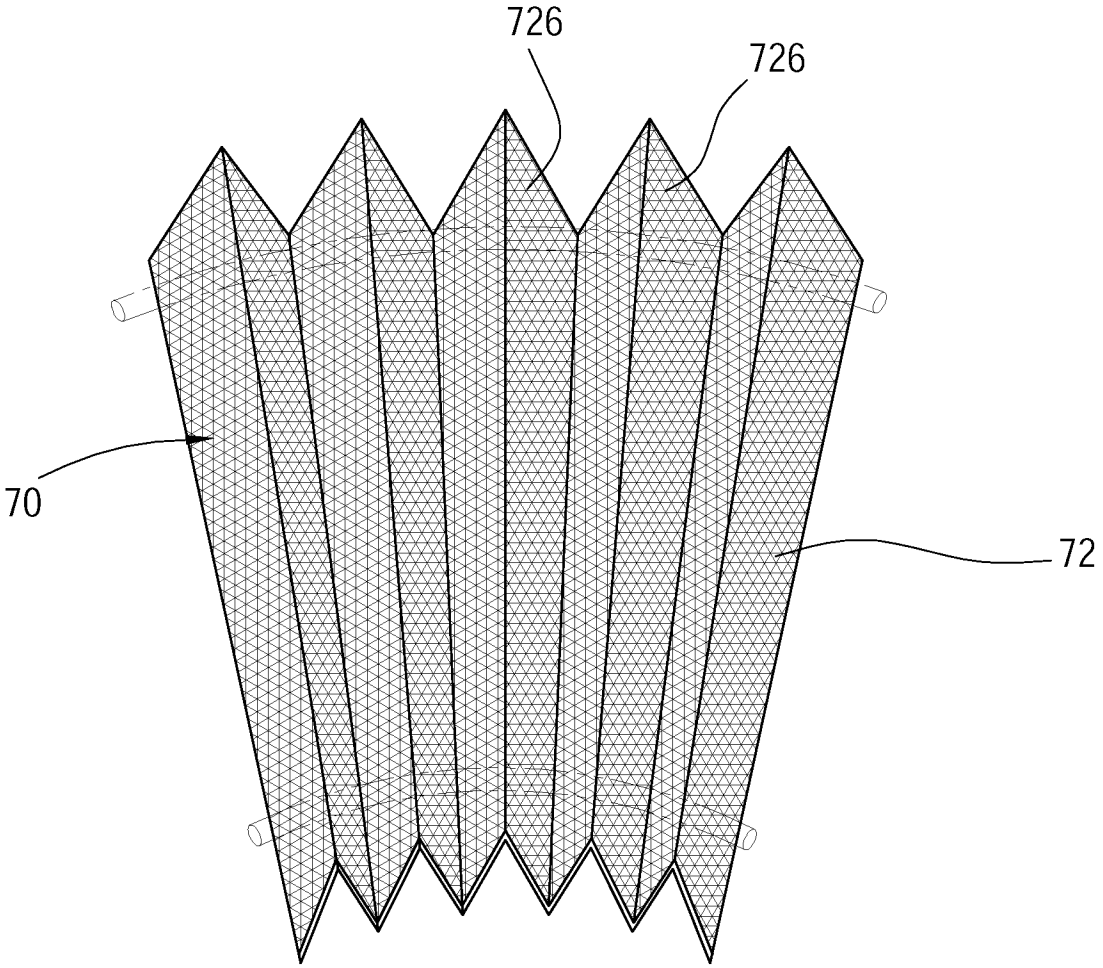
FIG. 15 is a schematic view of an infrared ray generation mesh of a sixth embodiment.

As illustrated in FIG. 15, an infrared ray generation mesh 70 of a sixth embodiment according to the present invention includes a structure which is similar to that of the fourth embodiment. The infrared ray generation mesh 70 of the current embodiment is different from that of the fourth embodiment in that a cross section of the corrugations 726 of the infrared ray generation mesh 70 is serrated.

Figure 16:
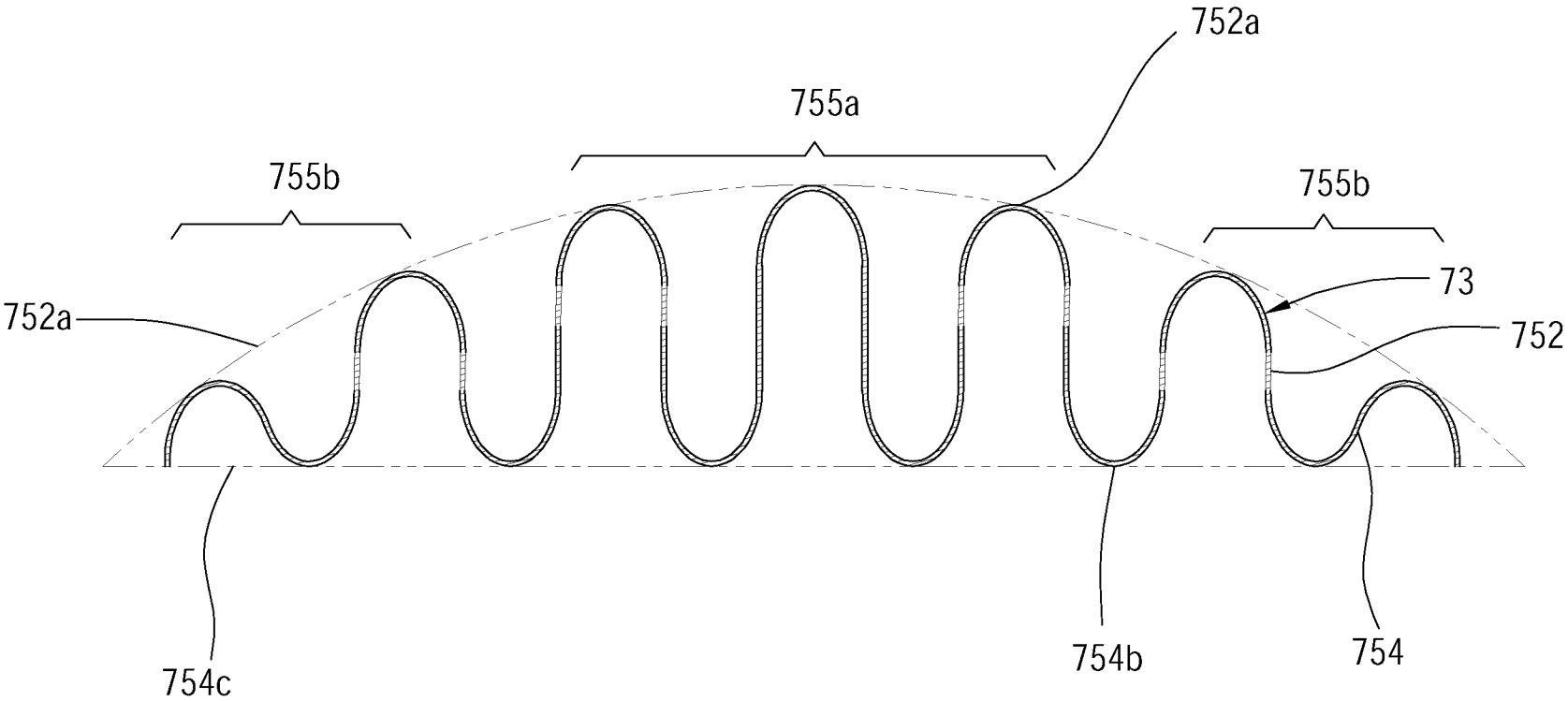
FIG. 16 is a cross-sectional view of an infrared ray generation mesh of a seventh embodiment.

FIG. 16 illustrates an infrared ray generation mesh 73 of the seventh embodiment according to the present invention. The mesh body 75 includes a middle part 755*a* and two side parts 755*b*, wherein the two side parts 755*b* are located respectively on opposite sides of the middle part 755*a*. A distance from each of the first crests 752*a* to corresponding one of the second crests 754*b* on the middle part 755*a* is larger than a distance from each of the first crests 752*a* to corresponding one of the second crests 754*b* on each of the side parts 755*b*, such that the infrared rays scattering angle which are emitted by the facing-outward first surface 752 of the infrared ray generation mesh 73 is greater, resulting in a wider heating range of the combustion device. In practice, the first crests 752*a* can be located on a first reference surface 752*c* and the second crests 754*b* can be on a second reference surface 754*c*. The first reference surface 752*c* can be a curved surface while the second reference surface 684*c* can be a flat or curved surface.

Figure 17:
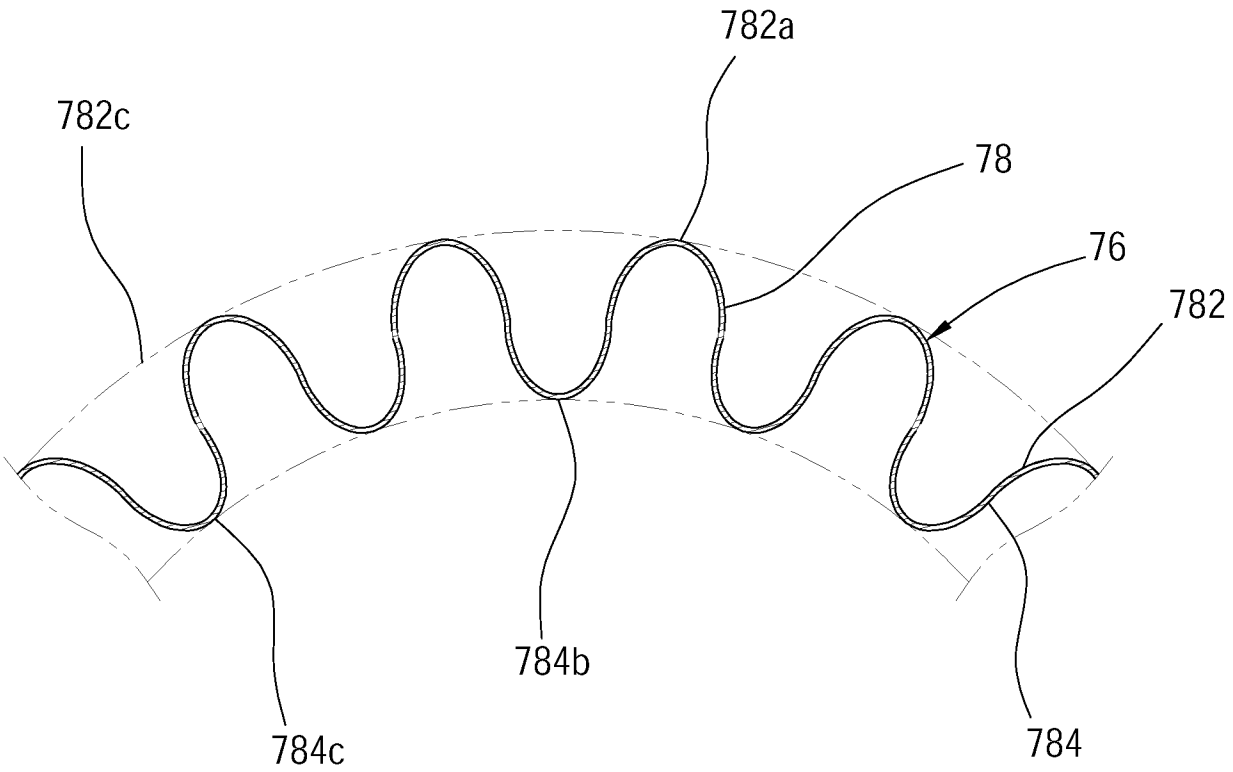
FIG. 17 is a cross-sectional view of an infrared ray generation mesh of an eighth embodiment.

FIG. 17 illustrates an infrared ray generation mesh 76 of the eighth embodiment according to the present invention. Wherein, a first reference surface 782*c* and a second reference surface 784*c* are both curved surfaces, resulting in a greater scattering angle of the infrared rays emitted by the infrared ray generation mesh 76 and a wider heating range of the combustion device.

Figure 18:
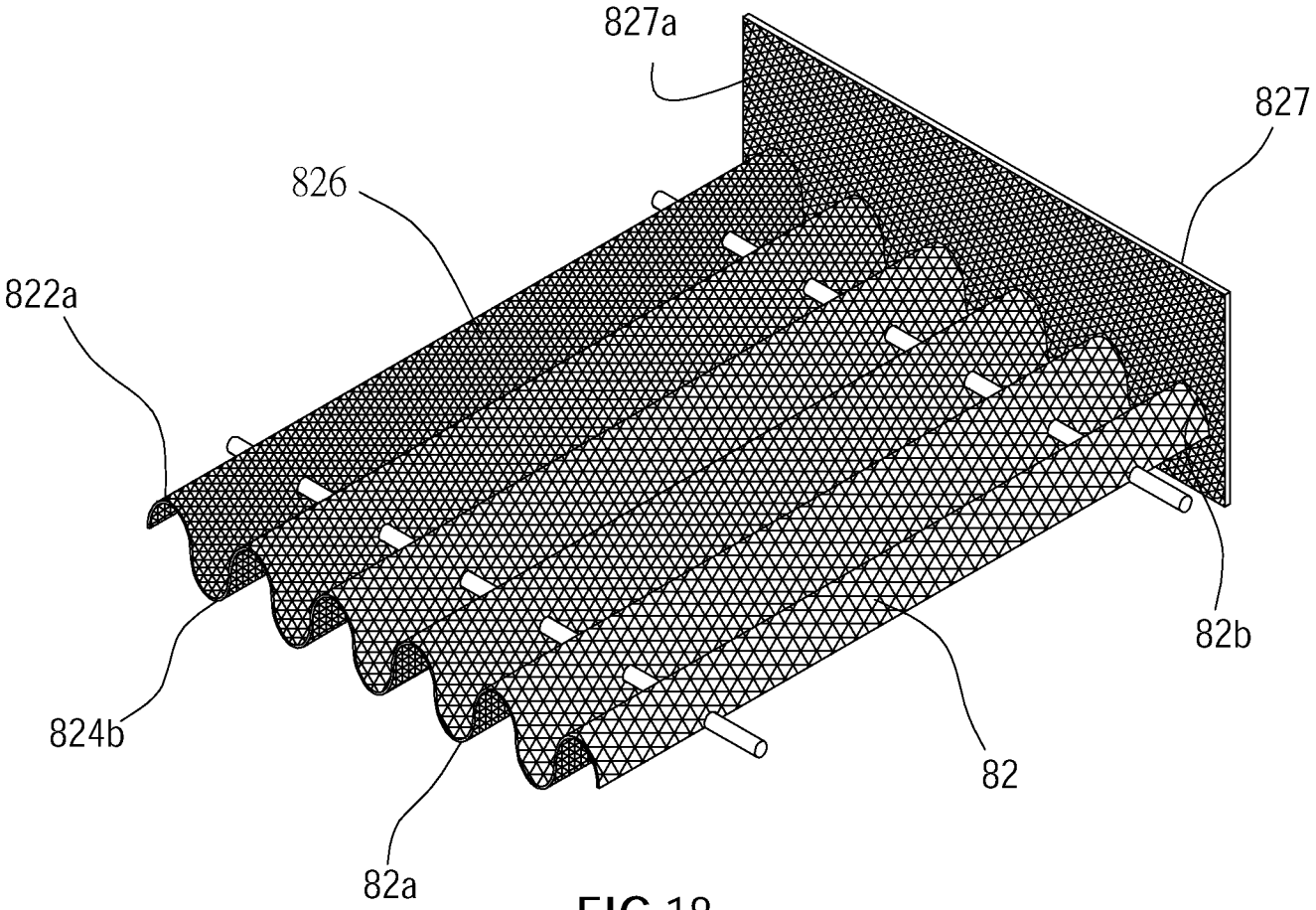
FIG. 18 is a perspective view of an infrared ray generation mesh of a ninth embodiment.
Figure 19:
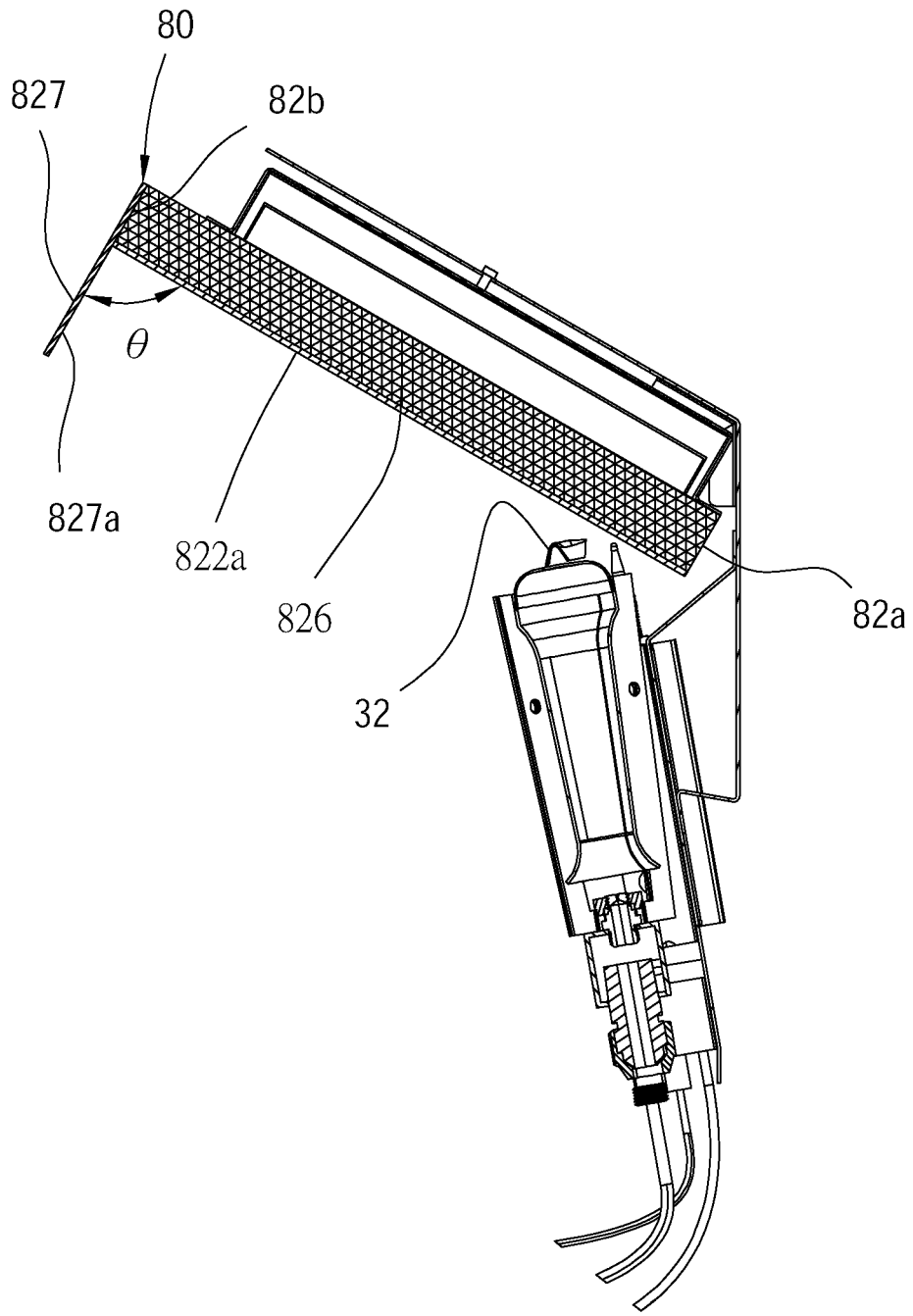
FIG. 19 is a cross-sectional view of a combustion device of the ninth embodiment.

FIG. 18 and FIG. 19 illustrate an infrared ray generation mesh 80 and a combustion device of the ninth embodiment according to the present invention. Besides the mesh body 82, the infrared ray generation mesh 80 further includes a retaining mesh 827 disposed corresponding to the second part 82*b*. An angle θ is formed between the surface 827*a* of the retaining mesh 827 and a long axis of each of the first crests 822*a*, wherein the angle θ is equal to or greater than 90 degrees, and more preferably, between 90 and 135 degrees. The retaining mesh 827 can be joined to the second part 82*b* by welding, locking or binding. In addition, it is able to integrally bend an infrared ray generation mesh to form the retaining mesh 827 and the mesh body 82. Incidentally, the retaining mesh 827 could be utilized in the mesh body in the first to the eighth embodiments while the means of integrally bending could be also utilized in the infrared ray generation mesh of the first to the eighth embodiments.

As illustrated in FIG. 19, through the way to dispose the retaining mesh 827, infrared ray generation mesh 80 is heated by open fire out of the flame outlets 32. Wherein, the open fire flows along the corrugations 826 from the first part 82*a* to the second part 82*b* and are partly blocked by the retaining mesh 827, such that the thermal energy of open fire is accumulated on the infrared ray generation mesh 80, increasing the infrared intensity generated by the combustion device.

Figure 20:
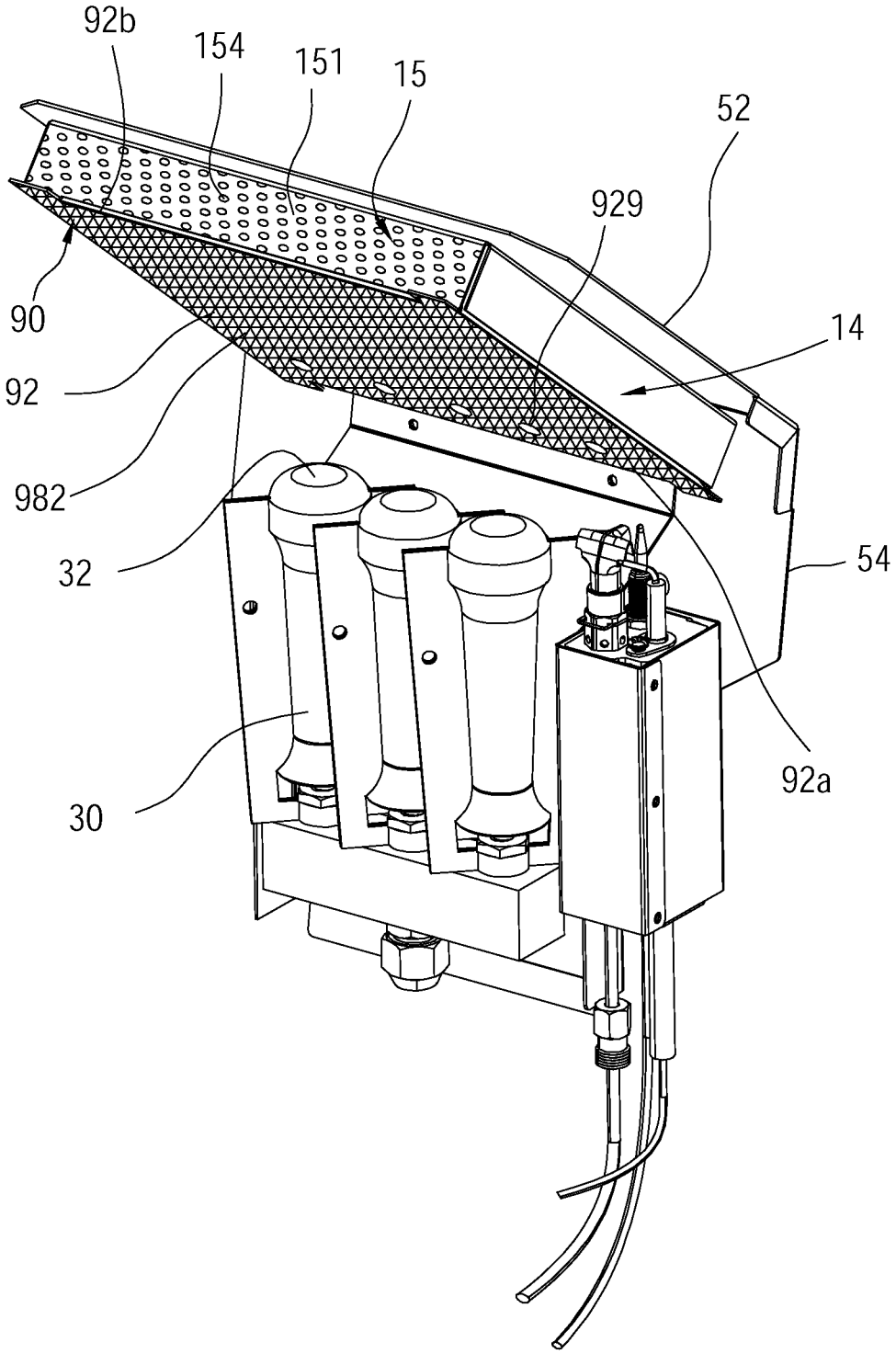
FIG. 20 is a perspective view of a combustion device of a tenth embodiment.

As illustrated in FIG. 20, a combustion device of a tenth embodiment according to the present invention includes a structure which is similar to that of the first embodiment. The combustion device of the current embodiment is different from that of the first embodiment in that there are a plurality of holes 929 near the first part 92*a* on the infrared ray generation mesh 90. Hence, the holes 929 are also located near the flame outlets 32, whereby part of the flame generated by the flame outlets 32 enters the first surface 982 of the infrared ray generation mesh 90 to the second surface 984 through the holes 929 and flows along the backside of the infrared ray generation mesh 90 to the second part 92*b*. Thus, the infrared intensity emitted by the infrared ray generation mesh 90 near the second part 92*b* is increased, and the infrared intensity emitted by the overall infrared ray generation mesh 90 is thereby enhanced.

In addition, an infrared ray generation mesh of the eleventh embodiment as the following according to the present invention includes a structure which is similar to that of the tenth embodiment. The infrared ray generation mesh of the current embodiment is different from that of the tenth embodiment in that the infrared ray generation mesh has a first area and a second area. In the current embodiment, the first area need not have holes like the holes 929 in the tenth embodiment. The first area and the second area have different cover rates per unit area, wherein the first area close to the flame outlets 32 has a smaller cover rate while the second area far away from the flame outlets 32 has a greater cover rate. Both cover rates range from 43% to 64% but are different from each other. Through different cover rates, as the infrared ray generation mesh 90 is heated by the open fire of the flame outlets 32, part of the open fire passes more easily from the first area which has a smaller cover rate through the infrared ray generation mesh and flows along the backside of the infrared ray generation mesh 90 from the first part 92*a* to the second part 92*b*. Since the second area has a greater cover rate, more thermal energy generated by the open fire could be accumulated on the second area of the infrared ray generation mesh 90 and generates higher infrared intensity so as to increase the infrared intensity emitted by the infrared ray generation mesh 90 near the second part 92*b* and thereby enhance the infrared intensity emitted by the overall infrared ray generation mesh 90.

It must be pointed out that the embodiments described above are only some embodiments of the present invention. All equivalent structures which employ the concepts disclosed in this specification and the appended claims should fall within the scope of the present invention.

What is claimed is:

1. A combustion device, comprising:

at least one burner having a flame outlet, wherein the at least one burner is for burning gas to generate flame through the flame outlet;

an infrared ray generation mesh corresponding to the flame outlet, the infrared ray generation mesh having a first surface and a second surface positioned back-to-back, wherein the first surface is exposed outside; the infrared ray generation mesh being flame heated by the at least one burner to generate infrared rays; and an infrared reflective plate disposed outside the second surface of the infrared ray generation mesh, the infrared reflective plate having a reflective surface facing to the second surface;

wherein the infrared reflective plate has a reflective structure, the reflective structure includes a plurality of convex parts and a plurality of embossings, each of the embossings located between two adjacent convex parts.

2. The combustion device of claim 1, wherein the infrared ray generation mesh includes a mesh body which has a first part and a second part on opposite sides, the mesh body is bent or folded integrally to form a plurality of corrugations, each of which extends from the first part to the second part; the mesh body is flame heated to generate infrared rays.

3. The combustion device of claim 2, wherein the flame outlet of the at least one burner faces an extending direction of at least part of the corrugations.

4. The combustion device of claim 2, wherein cross sections of the corrugations are waved.

5. The combustion device of claim 2, wherein cross sections of the corrugations are serrated.

6. The combustion device of claim 2, wherein the corrugations have a plurality of first crests on the first surface and the first crests are located on a defined first reference surface, the corrugations have a plurality of second crests on the second surface and the second crests are located on a defined second reference surface.

7. The combustion device of claim 6, wherein the first reference surface is a curved surface.

8. The combustion device of claim 6, wherein the first reference surface is a flat surface.

9. The combustion device of claim 2, wherein the mesh body has a middle part and two side parts, the two side parts are located respectively on opposite sides of the middle part, the corrugations form a plurality of first crests on the first surface, and the corrugations form a plurality of second crests on the second surface; a distance from each of the first crests to corresponding one of the second crests on the middle part is larger than a distance from each of the first crests to corresponding one of the second crests on each of the side parts.

10. The combustion device of claim 2, further comprising at least one fixation bar, wherein the at least one fixation bar is joined to the corrugations.

11. The combustion device of claim 2, further comprising at least one fixation bar, wherein the at least one fixation bar penetrates the corrugations.

12. The combustion device of claim 2, wherein the corrugations have a plurality of first crests on the first surface, and the corrugations have a plurality of second crests on the second surface; a spacing between two adjacent first crests and a spacing between two adjacent second crests are getting larger from the first part toward the second part.

13. The combustion device of claim 2, wherein the corrugations extend along the same direction.

14. The combustion device of claim 2, wherein the corrugations have a plurality of first crests on the first surface, the infrared ray generation mesh includes a retaining mesh joined to the second part, an angle is formed between the retaining mesh and a long axis of each of the first crests on the mesh body.

15. The combustion device of claim 14, wherein the angle is equal to or greater than 90 degrees.

16. The combustion device of claim 2, wherein the mesh body is a rectangular shape, a peripheral edge of the mesh body has four edges, two of the opposite edges form the first part and the second part.

17. The combustion device of claim 2, wherein a peripheral edge of the mesh body is a circular shape, the peripheral edge is divided into two halves, the first part and the second part are located respectively on the two halves.

18. The combustion device of claim 1, wherein the infrared ray generation mesh includes a mesh body which has a first part and a second part on opposite sides, the first part is closer to the flame outlet than the second part, the mesh body has a plurality of holes near the first part.

19. A combustion device, comprising:

at least one burner having a flame outlet, wherein the at least one burner is for burning gas to generate flame through the flame outlet;

an infrared ray generation mesh corresponding to the flame outlet, the infrared ray generation mesh having a first surface and a second surface positioned back-to-back, wherein the first surface is exposed outside; the infrared ray generation mesh being flame heated by the at least one burner to generate infrared rays; and an infrared reflective plate disposed outside the second surface of the infrared ray generation mesh, the infrared reflective plate having a reflective surface facing to the second surface;

wherein the infrared ray generation mesh has a cover rate per unit area, the cover rate ranges from 43% to 64%.

20. The combustion device of claim 19, wherein the infrared ray generation mesh has a first area and a second area, the infrared ray generation mesh has the cover rate per unit area on the first area and has another cover rate per unit area on the second area, the another cover rate ranges from 43% to 64% and is different from the cover rate.

21. The combustion device of claim 20, wherein the first area is close to the flame outlet, the second area is far away from the flame outlet, and the cover rate is smaller than the another cover rate.

* * * * *